US005221438A

United States Patent [19]

Takeuchi

[11] Patent Number: 5,221,438

[45] Date of Patent: Jun. 22, 1993

[54] SUPPORTING DEVICE FOR DEWATERING ELEMENTS

[75] Inventor: Hiroshi Takeuchi, 490-25, Nakano, Fuji-shi, Shizuoka-ken, Japan

[73] Assignees: Hasegawa Machinery Limited; Hiroshi Takeuchi, both of Fuji, Japan; a part interest

[21] Appl. No.: 956,065

[22] Filed: Oct. 2, 1992

[30] Foreign Application Priority Data

Apr. 23, 1992 [JP] Japan ..... 4-130098

[51] Int. Cl.[5] ..... D21F 1/36

[52] U.S. Cl. ..... 162/352; 162/301

[58] Field of Search ..... 162/352, 374, 301, 300

[56] References Cited

U.S. PATENT DOCUMENTS 4,769,111 9/1988 Nevalairen et al. ..... 162/301

FOREIGN PATENT DOCUMENTS 3153305 10/1986 Fed. Rep. of Germany ..... 162/301

69885 12/1985 Finland ..... 162/301

2-200887 8/1990 Japan .

3-64636 10/1991 Japan .

*Primary Examiner*—Karen M. Hastings

*Attorney, Agent, or Firm*—Wenderoth, Lind & Ponack

[57] ABSTRACT

A device for supporting a plurality of dewatering elements contacting a lower surface of a paper-making belt, wherein the plurality of dewatering elements are pivotably connected with each other through a link, the dewatering elements each being aerially supported by a stand, the stand being provided with a jack capable of reciprocally moving upwardly and downwardly, an upper end of the jack being pivotably connected to the link so that each of the dewatering elements can be aerially supported thereon, the link being pushed up and pushed down by the upward and downward movements of the jack, thereby adjusting inclination of each dewatering element.

1 Claim, 3 Drawing Sheets

SUPPORTING DEVICE FOR DEWATERING ELEMENTS

BACKGROUND OF THE INVENTION

1. Field of the Invention

This invention relates to a device for supporting a plurality of dewatering elements disposed in contact relation with a lower surface of a paper-making belt.

2. Brief Description of the Prior Art

Heretofore, when a wet paper is introduced between a lower paper-making belt (for example, paper-making wire) and an upper paper-making belt (for example, paper-making wire) and dewatered between and by a plurality of dewatering elements contacting a lower surface of the lower paper-making belt and a plurality of dewatering elements contacting an upper surface of the upper paper-making belt in this introduction area, the dewatering elements are supported such that inclinations thereof can be adjusted in order to make the plane of contact between the lower dewatering elements and the upper dewatering elements into a uniformed continuous plane (plane of curvature).

For this purpose, Japanese Patent Publication No. Hei 3-64636 and Japanese Early Laid-Open Patent Publication No. Hei 2-200887, for example, disclose a construction in which each dewatering element is supported by an air tube or air bag, and inclinations of the various dewatering elements are adjusted by individually moving the dewatering elements upwardly and downwardly by increasing or decreasing the air filled in the air tube or air bag.

However, the conventional method for individually moving the dewatering elements upwardly and downwardly using the air tube or air bag has the problems that since air pressure is applied individually to each dewatering element, the adjacent dewatering elements are controlled their upward movements and downward movements independently from others, and as a result, the dewatering elements are not equal in height on the adjacent line. In addition, it has the problem that construction is complicated and assembling work at the side is troublesome.

SUMMARY OF THE INVENTION

It is therefore an object of the present invention to provide a supporting device for dewatering elements in which a plurality of dewatering elements contacting a lower surface of a paper-making belt can be moved upwardly and downwardly in the manner operatively connected to one another so that a uniformed continuous plane (plane of curvature) can be properly formed at an area of contact with respect to the upper and lower paper-making belts.

In order to achieve the above object, there is essentially provided a device for supporting a plurality of dewatering elements contacting a lower surface of a paper-making belt, wherein said plurality of dewatering elements are pivotably connected with each other through a link, said dewatering elements each being aerially supported by a stand, said stand being provided with a jack capable of reciprocally moving upwardly and downwardly, an upper end of said jack being pivotably connected to said link so that each of said dewatering elements can be aerially supported thereon, said link being pushed up and pushed down by the upward and downward movements of said jack, thereby adjusting inclination of each dewatering element.

According to the dewatering elements supporting device of the present invention, the plurality of dewatering elements are pivotably connected each other through the link, and each dewatering element can be freely moved upwardly and downwardly through the link. With the foregoing link connection construction, when the jack, also served as the stand, is actuated in order to push up or push down an intermediate portion of each link with an adequate force, each dewatering element is moved upwardly and downwardly through the link. Owing to this action and the tensile force of the lower paper-making belt, a continuous plane is naturally formed at the area of contact between each dewatering element and the lower surface of the paper-making belt.

This supporting device can be assembled by pivotably connecting the stand (jack) to the link. Therefore, a supporting device of a single construction can be assembled at the site very easily.

DETAILED DESCRIPTION OF THE EMBODIMENT

One embodiment of the present invention will now be described with reference to FIGS. 1 through 4 inclusive.

Figure 2A:
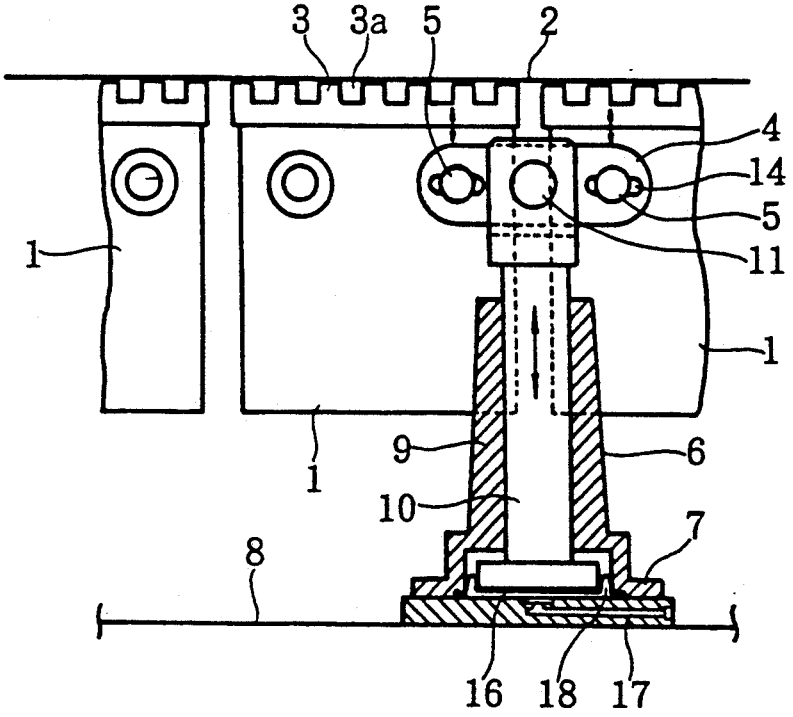
FIG. 2(A) is a side view showing an important portion, in section, of the above supporting device.
Figure 2B:
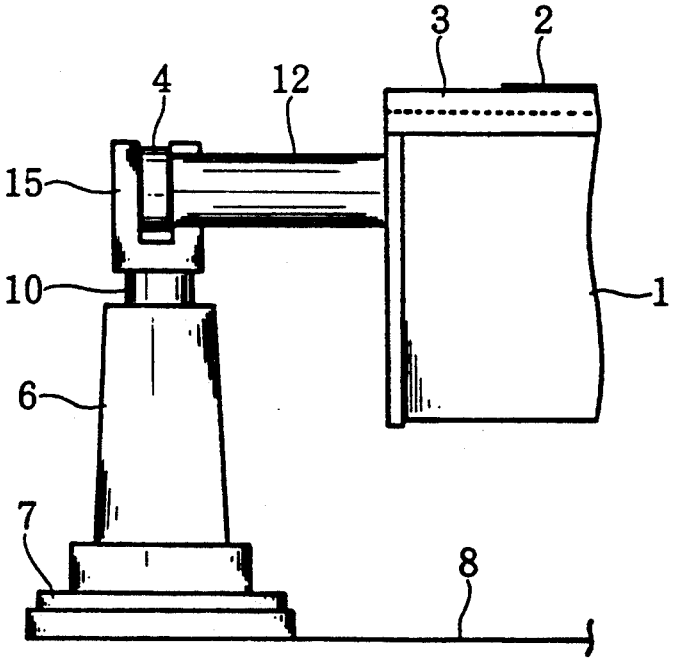
FIG. 2(B) is a front view of the above.

The drawings show a dewatering box 1 of a vacuum drawing type as a typical example of a dewatering element. This dewatering box 1, as shown in FIG. 2, is provided at an open surface thereof with a plurality of blades 3 disposed in a paper-making direction of a paper-making belt 2. Each blade 3 is in contact with a lower surface of the lower paper-making belt 2, so that pulsation is applied to a wet paper layer in order to enhance dewatering. The blades also serve to maintain the configuration of the traveling surface of the paper-making belt 2. The arrangement is such that moisture is drawn into the box 1 by a negative pressure in the box 1 through grooves 3*a* formed between the adjacent blades 3.

A plurality of dewatering boxes 1 are disposed in such a manner as to contact a lower surface of the paper-making belt 2, and the adjacent dewatering boxes 1 are pivotally connected by a link 4.

Figure 3:
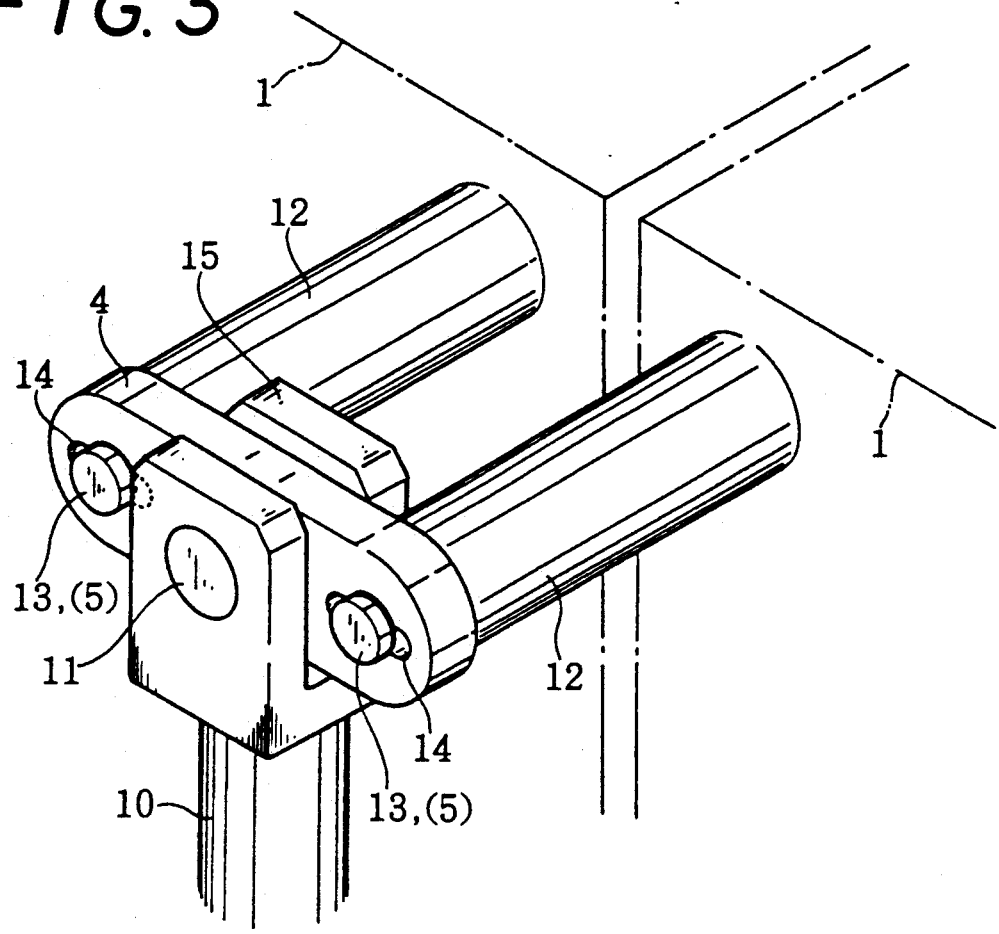
FIG. 3 is a perspective view of the above.

Specifically, as clearly shown in FIGS. 2 and 3, one end of each link 4 is pivotally connected to one of the adjacent boxes 1 through a pin 5, and the other end thereof is likewise pivotally connected to the other box 1 through another pin 5, so that the boxes 1 can be freely moved upwardly and downwardly through the pivotal pins 5 of the links 4, respectively.

The dewatering boxes 1 interconnected by the links 4 respectively are aerially supported by a plurality of stands 6.

Each stand 6 is installed on an installation surface 8 through a base 7 formed at a lower end thereof. A cylinder 9 is connected to an upper portion of the base 7, and a jack 10 is vertically movably inserted into the cylinder portion 9. An upper end of the jack 10 is pivotably connected to an intermediate portion of the link 4 through a pin 11. Preferably, the upper end of the jack 10 is connected to a central portion between the pin 5 at one end of the link 4 and the pin 5 at the other end of the link 4.

As a connecting construction between the link 4 and the jack 10, for example, a shaft 12 is provided in such a manner as to project from a side surface of the dewatering box 1, and a bolt 13 forming the pivotal pin 5 is loosely inserted into the pivotal hole 4 with the link 4 abutted against an end face of the shaft 12, in order to be threadedly engaged with the shaft 12, so that the link 4 can be pivoted about the bolt 13.

Figure 4A:
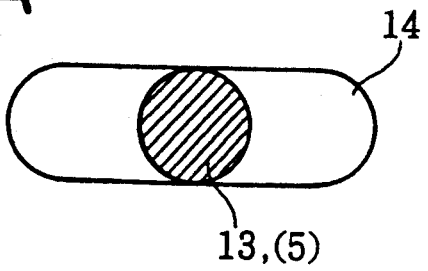
FIG. 4(A) is a schematic view showing a hole for pivotably connecting a dewatering element and a link.
Figure 4B:
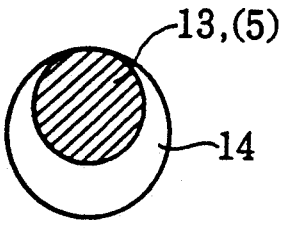
FIG. 4(B) is likewise a schematic view showing a modified embodiment of the pivotal hole.

In this case, as shown in FIG. 4A, the pivotal hole 14 is formed in an elongated hole extending in the traveling direction of the paper-making belt, so that the box 1 can be moved in the same direction. Further, as shown in FIG. 4B, the diameter of the pivotal hole 14 can be formed larger than the diameter of the pin, so that the dewatering box 1 can be slightly moved in the free direction.

The jack 10 is provided at an upper end thereof with a forked joint 15, and the joint 15 and the link 4 are connected through the pivotal pin 11.

In this way, the stand 6 has its own function for aerially supporting the dewatering box 1 and also has additional function for adjusting horizontality and inclination of the dewatering box 1 by the jack 10.

As means for moving the jack 10 upwardly and downwardly, an air pressure chamber 18 is formed within the base 7 of the stand 6, and a diaphragm 16 for supporting the jack 10 is disposed within the air pressure chamber 18, and a pressure medium (for example, air) is supplied therein from outside the base 7 in order to increase/decrease the pressure, thereby controlling the upward and downward movements of the jack 10. The numeral 17 denotes a feed port of the pressure medium.

When the diaphragm 16 is expanded and contracted by increasing and decreasing the pressure medium, the jack 10 is ascended or descended to exert a pushing-up force or a pushing-down force to a central portion of the link 4. As a result, the dewatering boxes 1, 1 pivotably connected to both ends of the link 4 are operatively connected through the link 4 under the tensile force of the paper-making belt 2 and moved upwardly and downwardly in order to properly form a continuous plane at an area of contact with respect to the paper-making belt 2.

Figure 1:
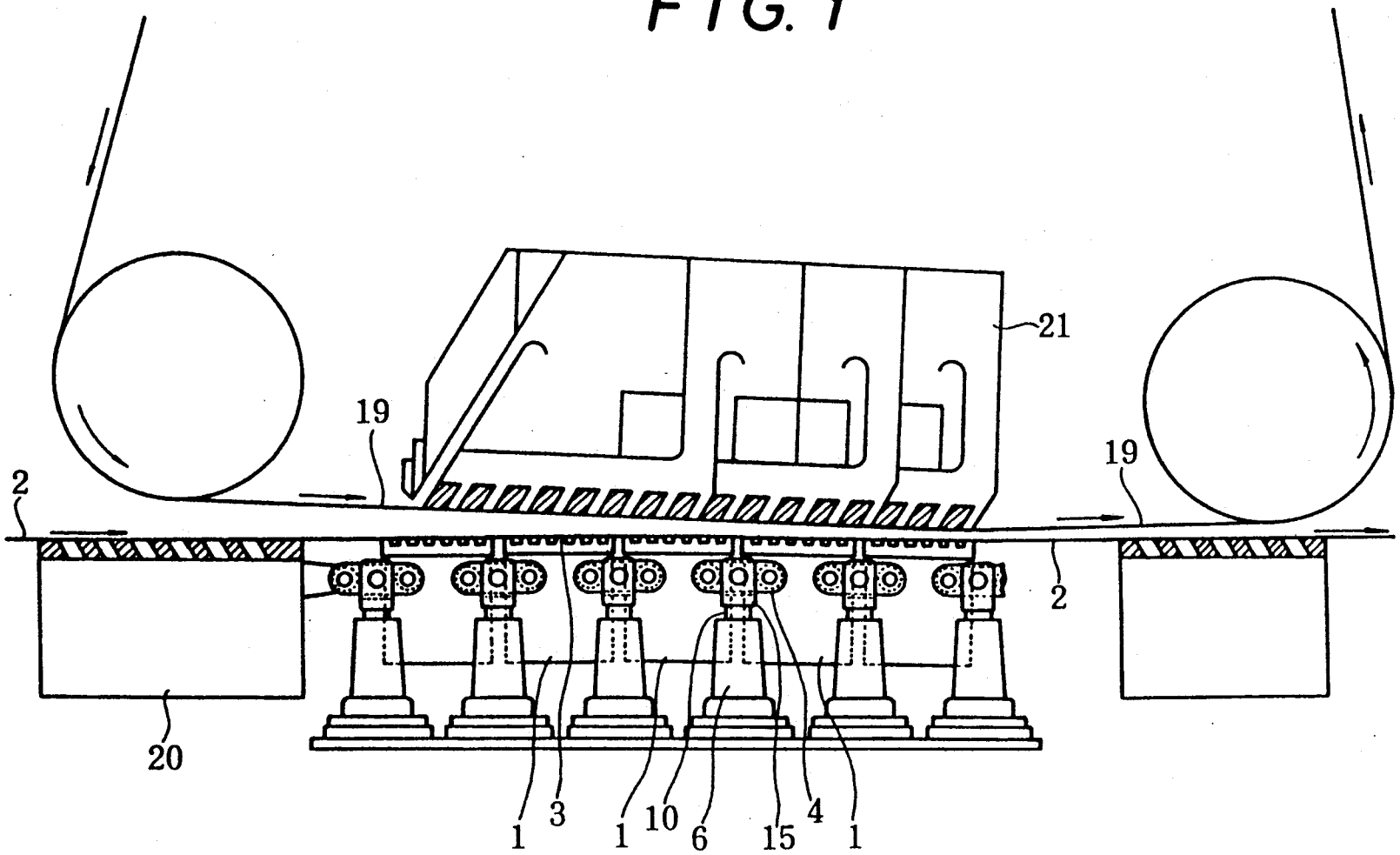
FIG. 1 is a side view, partly in section, of a dewatering elements supporting device of the present invention applied to a dewatering part.

FIG. 1 exemplifies a dewatering part in a paper-making device which requires the dewatering elements supporting device.

In this paper-making device, the paper-making belt 2 with the dewatering boxes 1 arranged thereon is served as a lower paper-making belt (paper-making wire), and an upper paper-making belt 19 (paper-making wire) running at the same speed in the same direction and in parallel relation with the lower paper-making belt 2 is disposed at an upper portion of the lower paper-making belt 2. For dewatering the wet paper attached to the upper surface of the lower paper-making belt 2, both the paper-making belts 2 and 19 are gradually closed narrowing a gap formed therebetween.

Since the capacity is reduced as the initial dewatering is progressed by the dewatering boxes 20 disposed at the introduction area of the lower paper-making belt 2 and concentration of the paper material is increased, the space or gap between the upper and lower paper-making belts 2 and 19 are formed in such a manner as to be gradually narrowed as it goes towards the outlet side from the inlet side in order to enhance easy introduction of the wet paper. At the area where the upper and lower paper-making belts 2 and 19 are closed, the dewatering box 1 is disposed in such a manner as to contact the lower surface of the lower paper-making belt 2, and the plurality of dewatering boxes 21 are disposed in such a manner as to contact the upper surface of the upper paper-making belt 19.

In order not to deshape the wet paper, the upper paper-making belt 19 is linearly stretched, while the lower paper-making belt 2 is disposed in a plane of curvature, and the wet paper is introduced to the closing area. The supporting device of the present invention can be effectively used as means for forming the lower paper-making belt 2 in a plane of curvature as mentioned.

However, the present invention can of course be used as a supporting device for a case where a plurality of dewatering boxes are arranged on a lower surface of a single paper-making belt without using the upper paper-making belt 19.

According to the present invention, by actuating the jack of the stand which also serves as a means for supporting the dewatering element, the dewatering elements pivotably connected to both ends of the link can be moved upwardly and downwardly through the link pivotally connected to the jack. As a consequence, along with the tensile force of the paper-making belt, a uniformed continuous place can be formed at the area of contact with respect to each dewatering element. Therefore, the serious problem for forming a harmful discrepancy on the adjacent line between the dewatering elements can be removed effectively.

Furthermore, the stand of the present invention is not only served as a means for aerially supporting the dewatering element but also as means for adjusting the horizontality and inclination of the dewatering element.

Moreover, according to the present invention, the supporting device can be assembled at the site by connecting the jack of the stand to the link, assembling work is easy, and construction is simple.

What is claimed is:

1. In a papermaking machine having a papermaking belt and a plurality of dewatering elements contacting a lower surface of the paper-making belt, the improvement comprising: a plurality of links, each link pivotably connecting each two adjacent dewatering elements with each other, and a plurality of devices for aerially supporting the dewatering elements, said devices each having a stand, said stand including a jack, means for reciprocally moving said jack upwardly and downwardly, an upper end of said jack being pivotably connected to a corresponding link so that each of said dewatering elements can be aerially supported thereon, said corresponding link being pushed up and pushed down by the upward and downward movements of said jack, thereby adjusting inclination of each dewatering element.

* * * * *